United States Patent [19]

Fields, III

[11] Patent Number: 4,921,115

[45] Date of Patent: May 1, 1990

[54] METHOD AND SYSTEM FOR SECONDARY CONTAINMENT

[75] Inventor: Grethel C. Fields, III, Jacksonville, Fla.

[73] Assignee: Ray Treadwell Contractors, Inc., Jacksonville, Fla.

[21] Appl. No.: 410,027

[22] Filed: Sep. 20, 1989

Related U.S. Application Data

[63] Continuation of Ser. No. 182,342, Apr. 18, 1988, abandoned.

[51] Int. Cl.[5] ..... B65D 88/76

[52] U.S. Cl. ..... 220/18; 52/742; 137/312; 141/86; 220/85 F

[58] Field of Search ..... 52/20, 741, 742; 137/312, 266, 590.5; 141/186, 88, 98; 220/18, 85 F, 86 R; 222/108; 405/36, 52

[56] References Cited

U.S. PATENT DOCUMENTS

| | | | |
|---|---|---|---|
| 4,278,115 | 7/1981 | Briles | 141/86 |
| 4,457,349 | 7/1984 | Vazin | 141/86 |
| 4,491,147 | 1/1985 | Argandona | 220/18 |
| 4,520,852 | 6/1985 | Klein | 141/86 |
| 4,527,708 | 7/1985 | Dundas et al. | 220/18 |
| 4,615,362 | 10/1986 | Hartman et al. | 141/86 |
| 4,655,361 | 4/1987 | Clover | 220/18 |
| 4,659,251 | 4/1987 | Petter et al. | 141/86 |
| 4,696,330 | 9/1987 | Raudman et al. | 141/86 |
| 4,706,718 | 11/1987 | Milo | 141/86 |
| 4,717,036 | 1/1988 | Dundas et al. | 220/85 F |

*Primary Examiner*—Jimmy G. Foster
*Attorney, Agent, or Firm*—Arthur G. Yeager

[57] ABSTRACT

Secondary leak containment for petroleum dispensing stations utilizes a rigid container mounted in the foundation beneath the station. The container has an outwardly directed flange positioned at the midplane of the upper concrete slab. A removable cover and panel are used to prevent concrete from entering the container when the concrete slab is poured and formed. The container rests upon a first depth of compacted soil used to cover the petroleum supply tanks and is surrounded and supported laterally by a second depth of soil and or gravel that extends upwardly to support the concrete slab.

21 Claims, 3 Drawing Sheets

METHOD AND SYSTEM FOR SECONDARY CONTAINMENT

This is a continuation of copending application Ser. No. 07/182,342 filed on Apr. 18, 1988 now abandoned.

BACKGROUND OF THE INVENTION

1. FIELD OF THE INVENTION

The present invention relates to systems and methods for providing secondary containment for petroleum dispensing apparatus and particularly to fiberglass containers used for containment when leaks occur in such apparatus.

2. PRIOR ART

The increased awareness of potential groundwater contamination from petroleum products and the regulations to deal with the issue has resulted in a number of methods and apparatus for prevention or reduction of such contamination.

Presently, there are two principal methods and several products for the reduction of contamination caused by leaks used in and around petroleum storage tanks and dispensing islands and gas stations. The first method involves the use of double wall piping. This method is excellent for containing leaks associated with product pipes, but the double wall protection terminates just below the dispensing unit and does not afford protection to the ground lying directly beneath the dispensing units.

The second method for the reduction of contamination caused by leaks utilizes containment systems. This method involved placing large petroleum-resistant plastic liners under storage tanks and around the base of pumps and piping at dispensing islands. While this system is adequate, the methods and products involve custom manufacturing and custom installation at the site. The materials are also very costly, cumbersome and awkward to use.

What is most desired in secondary containment is a method and system that provides adequate containment and can be used with any type piping, whether steel or fiberglass. The apparatus should be usable with any dispensing islands and be compatible with any other secondary containment. The apparatus should also lend itself to mass production to minimize the cost.

The present invention utilizes a fiberglass container as a reservoir for the collection of leaked petroleum products. The container is mounted underneath a pump or other outlet to be installed on a dispensing island. A container has an outwardly extending flange integral to the perimeter of the upwardly facing open top. Four vertical sides extend downward and are integral with a horizontal bottom.

The container according to this invention is positioned vertically on the excavated area partially back filled after the installation of the main storage tanks used in the system. Backfill is installed to a level spacedly below the flange after the necessary field connections for the supply line and pump power are provided therethrough. The upper surface of the back fill is then covered with concrete after the installation of a temporary cover over the container to prevent concrete from flowing thereinto. The cover is removed prior to the connections being made to the specific dispensing apparatus that will be used. The particular system and method used in accord with this invention offers substantial advantages in cost and efficiencies over the prior art. This is especially true when it is necessary to retrofit existing storage and dispensing facilities. The ease of use of a single container connected with a concrete surface as compared to fabric that is custom-cut, sealed and installed is self-evident.

SUMMARY OF THE INVENTION

This invention relates to methods and systems for providing leak containment for petroleum dispensing apparatus which is mounted to a foundation slab which includes an elongated rigid container having an open top portion positioned within the foundation and beneath the dispensing apparatus. The container has at least one vertical side wall contiguous with the top portion and an oppositely disposed bottom portion integral with the side wall. The top portion has a generally horizontal outwardly extending flange for securing the container to the foundation slab. A first depth of soil is provided beneath the foundation slab which has an upper surface onto which the bottom portion of the container rests. A second depth of soil has an upper surface and is provided above the upper surface of the first depth of soil. The foundation slab is made of concrete formed on the upper surface of the second depth of soil with the container being substantially located in the second depth of soil with its side wall being laterally supported thereby and the flange being embedded permanently within the concrete slab. The concrete slab has an opening generally vertically therethrough aligned above the open top of the container for allowing petroleum that leaks from the apparatus to flow into the container and to be retained therein. The flange of the container is positioned generally in the midplane of the concrete slab and the open top portion is closed with a removable covering when the concrete slab is being poured and formed.

The system also has a covering means for closing the open top portion when the concrete slab is being poured and formed, the covering means having a removable center portion and peripheral portion permanently positioned on the upper surface of the flange and affixed in the concrete slab. Normally, the removable center portion is slightly larger in size to accommodate a downwardly directed sleeve portion of the dispensing apparatus. The container is adapted to receive at least one conduit through an opening in the side wall for supplying petroleum to the dispensing apparatus and includes sealing means for providing a leak-proof seal between the side wall and outwardly of the conduit. Likewise, an electrical conduit is suitably sealed through the side wall of the container.

In one aspect of the invention a method is provided for leak containment for the petroleum dispensing apparatus mounted on a concrete slab foundation and having a petroleum inlet supply conduit is seen to have the following steps: positioning a rigid petroleum impervious container having a flange at its upper end beneath the dispensing apparatus; sealing the inlet supply conduit to and through a side wall of the container; and embedding the flange of the container generally medially of the thickness of the concrete slab foundation.

The inside of the container is protected during the pouring of concrete using the following steps: positioning a cover over the top of the container during the pouring and forming of the concrete slab; and removing at least a central portion of the cover from the top of the container when the concrete slab has sufficiently set so that access to the inside of the container is obtained through the concrete slab.

In another aspect the method includes a foundation having a first depth of soil, a second depth of soil placed on the first depth and a concrete slab formed on the second depth wherein the following steps are employed: positioning a container with an outwardly extending flange adjacent its open top end portion with its closed bottom on the surface of the first depth of soil beneath the prospective position of the petroleum dispensing apparatus; filling the second depth with soil on the first depth of soil to a height spaced closely below the flange in a manner to surround and provide lateral support for the wall of the container; positioning a cover over the top of the container; pouring and forming the concrete slab in a manner to embed the flange generally vertically medially in the concrete slab; and removing at least a generally central part of the cover from the top of the container to provide access through the slab into the container. The method may include the steps of: placing a removable form on the top surface of the cover generally centrally thereof; and removing the removable form.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
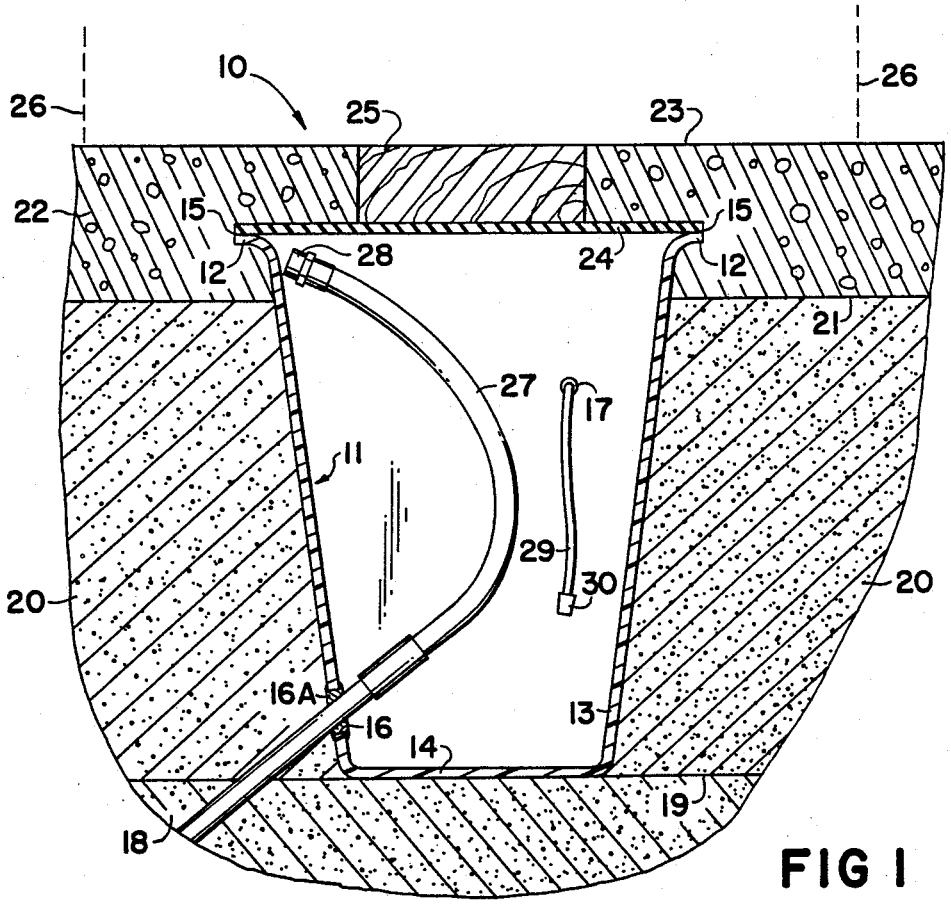
FIG. 1 is a sectional view of the containment system in accord with this invention as it appears at an intermediate point in its installation.
Figure 2:
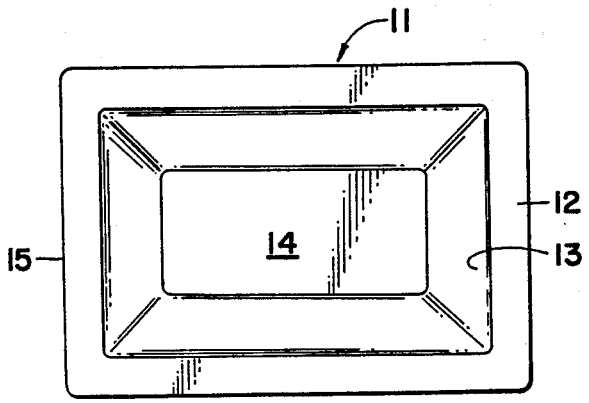
FIG. 2 is a top view of the container shown in FIG. 1.
Figure 3:
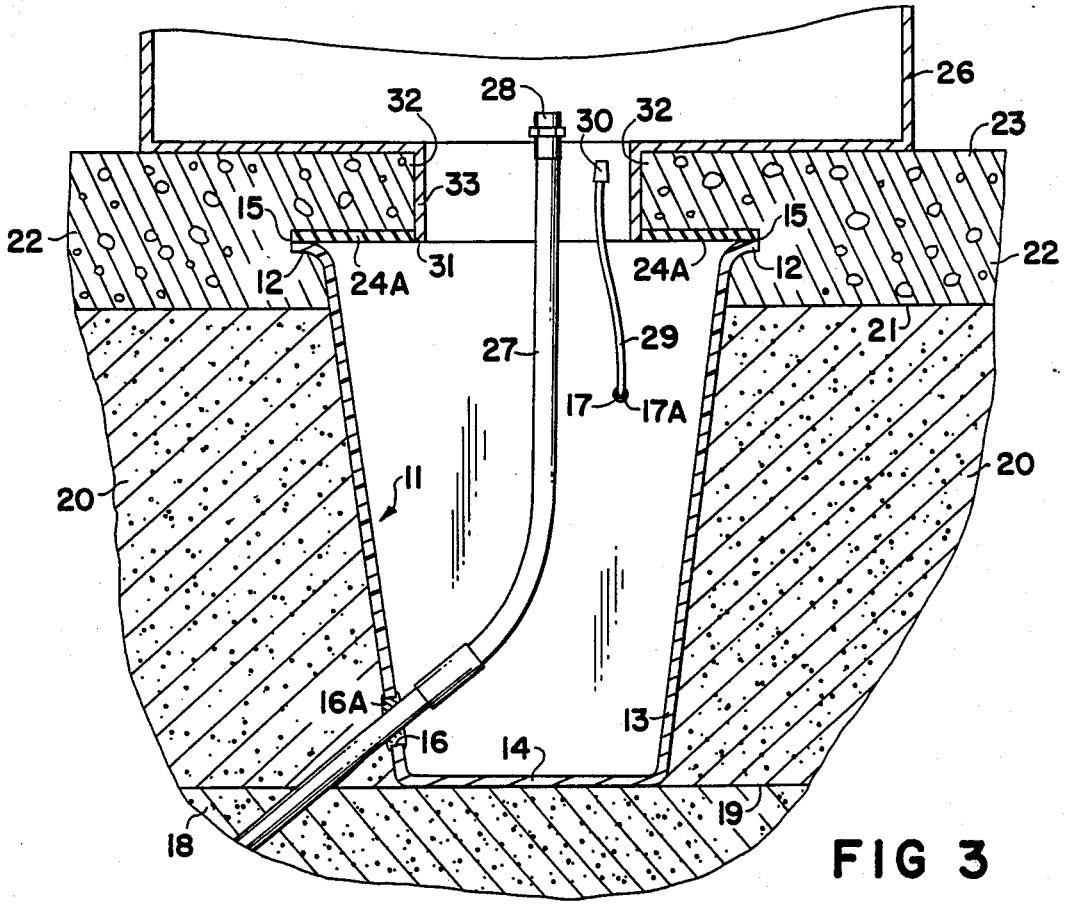
FIG. 3 is a sectional view of the system after installation of the housing for the petroleum dispensing apparatus.

Referring now to the drawings, the system for secondary containment is generally designated at 10 in FIG. 1. A rigid fiberglass or plastic container 11 resistant to petroleum includes an outwardly extending flange 12 around the perimeter and vertical side walls 13 which are integral to a flat bottom portion 14, as shown in FIG. 1 and 2. The container 11 rests on the surface 19 of foundation 18, which is a depth of soil covering petroleum supply tanks such as those used in gas stations and similar applications. During installation, holes 16 and 17 are cut out of the container 11 at points that will be specific to the particular tank type and arrangement being used.

The container 11 has an open top portion **12*a* sized to accommodate a wide variety of dispensing pumps and associated apparatus as will be described herein below. FIG. 2 illustrates the preferred form thereof of a substantially rectangular shape, but may be of any other appropriate shape and size, but should have a capacity of 20–40 gallons. The container 11 is positioned on surface 19 of foundation 18 and suitable piping and electrical conduits are sealed through the side walls of the container. Thereafter a second depth of soil 20 is added to surround and laterally support the container 11 to a height spacedly below the flange 12 as indicated by surface 21. A removable cover 24, typically of corrugated fiberboard or the like, is placed over the open top 12*a* to the edge 15 of container flange 12. A concrete slab 22 is formed on the surface 21, preferably 2½ inches above and below the flange 12 and extending inwardly onto the cover 24 a distance based upon the particular pump that will be used. A wooden knock-out panel 25 is placed on the cover 24 to allow for dispensing station housing 26, as will be discussed hereinbelow. Field connections for petroleum supply conduit 27 with cap 28 and electrical conduit 29 with cap 30 have been done including leak proof sealing around the conduits in a conventional manner. The conduits 27 and 29 are accessible via knockout panel 25 to be connected to the dispensers to be attached to slab 22**.

After the concrete slab 22 has been formed and set, panel 25 is removed and removable panel 24 is cut away to the edge 31 that is in vertical alignment with the formed concrete surface 32. In the preferred embodiment of the system according to the invention, the remaining material **24*a* of the cover 24 is left in place, as illustrated in FIG. 4**, but may be partially removed if desired.

A pump or dispenser housing 26 is placed on the upper surface 23 of the concrete slab 22 with an integral downwardly extending annular sleeve 33 extending to at least the lower edge 31 of the removable cover material that remains in the secondary containment system. Conduits 27 and 29 are pulled upwardly and will be secured to the pump (not shown) placed within housing 26. The size of the panel 25 to be employed in making the hole 32 in the concrete slab 22 is based upon the exterior dimensions of the sleeve 33 of the particular housing 26.

The container 11 is thus positioned as an enclosed reservoir which acts as an extension of the pump housing 26, providing containment of liquid which may be leaked from the dispensing apparatus container therewithin. The containment system according to the invention is thus easily and quickly installed with a minimum number of parts. In addition, the use of rigid containers 11 eliminates the rips and tears commonly associated with fabric liners.

Figure 4:
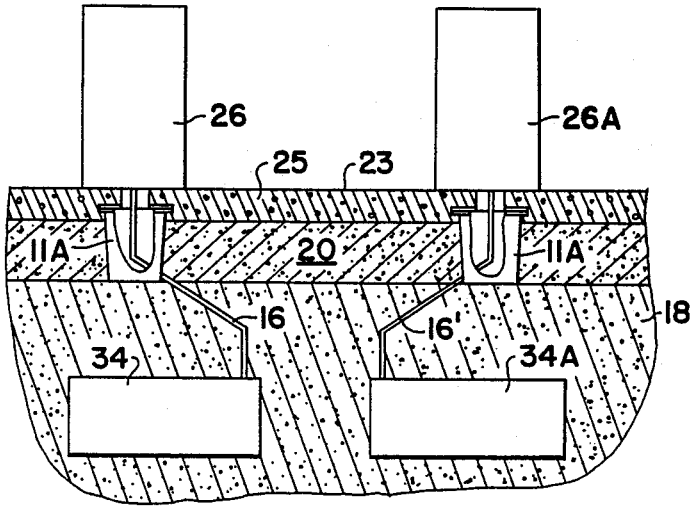
FIG. 4 is a pictorial view of the system associated with an installed dispensing island.

FIG. 4 pictorially illustrates the containment system installed at a dispensing island having two pump housings 26 and **26*a*, receiving supply lines 16, 16' respectively, two containers 11, 11*a* mounted beneath the pump housing 26, 26*a***, and the electrical connections not being shown for ease of illustration.

Conventional monitoring systems for detecting the presence of liquid in container 11 and means to pump the liquid therefrom may be installed either through one of the walls 13 of the container or routed via the pump housing sleeve 33 as dictated by the circumstances.

Figure 5:
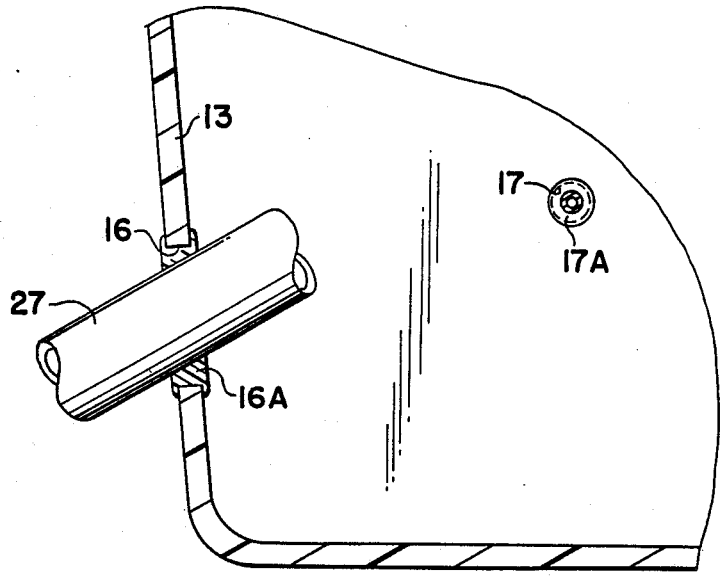
FIG. 5 is a partial detail in cross section of the sealing technique used at the point where a supply pipe passes through the sidewall of a container in accord with this invention.

FIG. 5 illustrates a preferred method of sealing around the conduits 27, 29 at the point they pass through side wall 13 of the container. A hole 16 is cut out and a conduit such as 27 is pulled through. Fiberglass patches **16*a*, 17*a*** are then applied to provide a leak proof seal.

As known to persons skilled in the art, conduit 27 may be an approved stainless steel flexible connector or, if rigid piping is employed, a three-dimensional swing joint (not shown) may be used conforming to N.F.P.A.—30 & 31. Construction and safety codes of various governmental entities must be followed, as commonly known, in initially constructing and/or retrofitting a petroleum station island with the leak containment system in accord with the disclosed invention.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A system for providing leak containment for petroleum dispensing apparatus mounted to a foundation slab having an upper surface comprising an elongated rigid container having an open top portion positioned within said foundation slab and beneath said dispensing apparatus, said open top portion being spaced downwardly from said upper surface a predetermined distance said container having at least one vertical side wall contiguous with said top portion and an oppositely disposed bottom portion integral with said side wall, said top portion having a generally horizontal outwardly extending flange for securing said container to said foundation slab said flange being entirely embedded in said foundation slab and being spaced downwardly from said upper surface.

2. The system as defined in claim 1 further comprising a first depth of soil having an upper surface onto which said bottom portion of said container rests, a second depth of soil having an upper surface and positioned above said upper surface of said first depth of soil, said foundation slab being of concrete formed on said upper surface of said second depth of soil, said container being substantially located in said second depth of soil with its said side wall being laterally supported thereby, said flange being embedded permanently within said concrete slab, having an opening generally vertically therethrough aligned above said open top of said container for allowing petroleum that leaks from said apparatus to flow into said container and to be retained therein.

3. The system as defined in claim 2, wherein said flange is positioned generally in the midplane of said concrete slab.

4. The system as defined in claim 2, wherein said open top portion is closed with a removable covering when said concrete slab is being poured and formed.

5. The system as defined in claim 2 further comprising covering means for closing said open top portion when said concrete slab is being poured and formed, said covering means having a removable center portion and peripheral portion permanently positioned on the upper surface of said flange and affixed in said concrete slab.

6. The system as defined in claim 5 wherein said removable center portion is slightly larger in size to accommodate a downwardly directed sleeve portion of said dispensing apparatus.

7. The system as defined in claim 1 wherein said container is adapted to receive at least one conduit through an opening in said side wall for supplying petroleum to said dispensing apparatus, sealing means for providing a leak-proof seal between said side wall and outwardly of said conduit.

8. The system as defined in claim 1 wherein said open top portion is open sufficiently to receive a downwardly directed sleeve portion of said dispensing apparatus.

9. The system as defined in claim 1 further comprising a first depth of soil having an upper surface, said bottom of said container positioned on and supported by said upper surface, a second depth of soil on top of said first depth and substantially surrounding said side wall of container, said second depth of soil having an upper surface spaced below said flange, said concrete slab being formed on said upper surface of said second depth of soil, said flange being permanently positioned within said concrete surface.

10. The system as defined in claim 1 further comprising covering means for closing said open top portion when said concrete surface is being poured and formed, a removable forming means positioned on the upper surface of said covering means for providing said concrete slab with an opening generally centrally above and into said container when said forming means and a portion of said covering means therebelow is removed.

11. A method for providing leak containment for petroleum dispensing apparatus mounted on a concrete slab foundation and having a petroleum inlet supply conduit comprising the steps of:

A. positioning a rigid petroleum impervious container having a flange at its upper end beneath the dispensing apparatus;

B. sealing the inlet supply conduit to and through a side wall of the container;

C. embedding the flange of the container generally medially of the thickness of the concrete slab foundation.

12. The method of claim 11 wherein step B includes the steps of:

D. positioning a cover over the top of the container during the pouring and forming of the concrete slab; and E. removing at least a central portion of the cover from the top of the container when the concrete slab has sufficiently set so that access to the inside of the container is obtained through the concrete slab.

13. A method for providing leak containment for petroleum dispensing apparatus mounted on a foundation having a first depth of soil, a second depth of soil placed on the first depth and a concrete slab formed on the second depth comprising the sequential steps of:

A. positioning a container having an open top end portion with its closed bottom on the surface of the first depth of soil beneath the prospective position of the petroleum dispensing apparatus;

B. filling the second depth with soil on the first depth of soil to a height spaced closely below the open top end portion in a manner to surround and provide lateral support for the wall of the container;

C. positioning a cover over the top end portion of the container;

D. pouring and forming the concrete slab in a manner to embed the top end portion generally vertically medially in the concrete slab; and E. removing at least a generally central part of the cover from the top end portion of the container to provide free access through the slab into the container so that leaks in the dispensing apparatus above the concrete slab will pass unimpededly through the opening in the concrete slab.

14. A method for providing leak containment for petroleum dispensing apparatus mounted on a foundation having a first depth of soil, a second depth of soil placed on the first depth of soil and a concrete slab formed on the second depth comprising the steps of:

A. positioning a container with an outwardly extending flange adjacent its open top end portion with its closed bottom on the surface of the first depth of soil beneath the prospective position of the petroleum dispensing apparatus;

B. filling the second depth with soil on the first depth of soil to a height spaced closely below the flange in a manner to surround and provide lateral support for the wall of the container;

C. positioning a cover over the top of the container;

D. placing a removable form on the top surface of the cover generally centrally thereof;

E. pouring and forming the concrete slab in a manner to embed the flange generally vertically medially in the concrete slab;

F. removing the removable form; and

G. removing at least a generally central part of the cover from the top of the container to provide access through the slab into the container.

15. In combination of a petroleum dispensing island including a foundation slab which has an upper surface and a bottom surface and an opening therethrough for passage of a petroleum carrying conduit and being adapted to have a housing for a petroleum dispensing pump secured to the upper surface wherein the housing includes a bottom portion having a downwardly disposed sleeve with a lower perimeter edge and adapted for placement within the opening of the slab, and a system for providing leak containment for the petroleum dispensing apparatus comprising an elongated rigid container with an open top portion and being adapted to be positioned beneath a dispensing apparatus, said top portion of said container being adapted to be disposed laterally around the opening in the slab, said container having a side wall and a bottom wall, the petroleum carrying conduit extending through one said wall of said container and sealed thereto to inhibit leakage of any contained petroleum from said container, the opening of the slab providing free access through the foundation slab into said container so that inadvertent petroleum leaks in the dispensing apparatus above the foundation slab and its connections to the petroleum carrying conduit will unimpededly pass through the opening in the foundation slab into said container and be retained therein.

16. In the combination as defined in claim 15 wherein said top portion of said container includes a generally horizontal outwardly extending flange for attachment of said container to said foundation slab.

17. In the combination as defined in claim 16 further including means for sealing said flange to said foundation slab.

18. In the combination as defined in claim 16 further including means for connecting said flange to said foundation slab.

19. In the combination as defined in claim 16 wherein said flange is embedded in said concrete slab.

20. A method for providing leak containment for petroleum dispensing apparatus mounted on a slab foundation which overlies a soil foundation and having a petroleum inlet conduit therethrough comprising the steps of:

A. excavating a portion of the soil foundation adjacent to the dispensing apparatus;

B. disconnecting the petroleum inlet conduit from the dispensing apparatus;

C. positioning a petroleum impervious container beneath the dispensing apparatus D. sealing the inlet supply conduit to and through a wall of the container;

E. connecting the petroleum inlet conduit to the dispensing apparatus; and

F. refilling the excavated portion of the soil foundation.

21. The method of claim 20 wherein step D includes the step of:

G. sealing the upper end of the container to the bottom surface of the foundation slab.

* * * * *